US005715535A

United States Patent [19]

Hamilton et al.

[11] Patent Number: 5,715,535

[45] Date of Patent: Feb. 10, 1998

[54] APPARATUS FOR CRADLING A BABY

[76] Inventors: Melissa E. Hamilton; Carlton B. Crutchfield, both of 790 Ashland Ave., St. Paul, Minn. 55104

[21] Appl. No.: 507,976

[22] Filed: Jul. 27, 1995

[51] Int. Cl.[6] ..... A41D 13/08; A41D 1/22; A41B 13/06

[52] U.S. Cl. ..... 2/59; 2/16; 2/46; 2/912

[58] Field of Search ..... 2/16, 22, 23, 24, 2/59, 46, 104, 242, 912, 913, 914, 915, 916, 917, 918, 919

[56] References Cited

U.S. PATENT DOCUMENTS

| | | | |
|---|---|---|---|
| 2,746,051 | 5/1956 | Stahly | 2/22 |
| 2,961,668 | 11/1960 | Hayes | 5/337 |
| 3,189,919 | 6/1965 | Chase | 2/16 |
| 3,911,497 | 10/1975 | Lewis, Jr. et al. | 2/16 |
| 4,120,052 | 10/1978 | Butler | 2/16 |
| 4,393,520 | 7/1983 | Koch | 2/16 |
| 4,756,026 | 7/1988 | Pierce, Jr. | 2/16 |
| 4,769,854 | 9/1988 | Williams | 2/22 |
| 4,926,501 | 5/1990 | Goosen | 2/22 |
| 5,133,085 | 7/1992 | de Pasquale Amicarelli et al. | 2/104 |
| 5,143,762 | 9/1992 | Ho | 428/35.7 |
| 5,170,503 | 12/1992 | Hightower, Jr. et al. | 2/22 |
| 5,173,967 | 12/1992 | Carter | 2/242 |
| 5,239,717 | 8/1993 | Sue | 2/104 |

*Primary Examiner*—Jeanette E. Chapman
*Attorney, Agent, or Firm*—Schwegman, Lundberg, Woessner & Kluth, P.A.

[57] ABSTRACT

An apparatus for cradling a baby with an arm comprising a padded biceps cuff for surrounding the upper arm, a padded forearm cuff for surrounding the forearm, and a connecting strap for connecting the padded biceps cuff to the padded forearm cuff to create a dual-cuff infant support cushion to provide comfort and support for an infant's head, and protection against problems associated with cradling a baby including tiredness, soreness, stiffness, and reduced blood flow to the arm on which the baby's head rests.

21 Claims, 4 Drawing Sheets

APPARATUS FOR CRADLING A BABY

BACKGROUND OF THE INVENTION

Babies are cradled by their mothers during nursing or by any person when being held, carried, or rocked. When cradled, the baby's head rests in the crook of the arm. As a result, the arm can quickly grow tired and sore. Cradling can also cut off the blood flow through that portion of the arm on which the baby's head or body is resting, causing the arm to fall asleep. Furthermore, the crook of the arm does not always provide adequate cushioning for an infant's head, causing discomfort for the infant. If sleeves are worn, the surface on which the infant's head rests may be comprised of a fabric such as scratchy wool, or other harsh fabric used in clothing, also causing discomfort for the infant.

Many devices have been utilized to provide a buffer between the baby and arm, such as wrapping the child in a blanket, or laying a blanket, towel, or pillow across the arm.

Although these methods or devices are useful in certain situations, there are many times, for various reasons, that it is undesirable to wrap the baby in a blanket, or to wrap a blanket or towel around the arm.

For the foregoing reasons, there is a need for a more compact and convenient cushioning device to provide a comforting buffer between a baby's head and the arm of a person cradling or nursing the baby.

SUMMARY OF THE INVENTION

The present invention provides a compact and close-fitting apparatus for cradling a baby in an arm, which comprises a padded biceps cuff for surrounding the biceps, a padded forearm cuff for surrounding the forearm, and a connecting strap linking the padded biceps cuff and padded forearm cuff to create a dual-cuff infant support cushion which maintains its position during use. The apparatus of the present invention provides a convenient yet comfortable buffer between a baby's head and the arm of the person cradling the baby to not only protect the person from problems associated with cradling a baby including soreness, tiredness, stiffness, and blood flow restriction in the arm, but to also provide a cushioned resting place for the infant's head. The connecting strap of the present invention is detachable which allows each cuff to be worn and used independently of the other.

The invention has advantages which cannot be attained by current devices or methods. The fired design and comfortable fabric used in the present invention allows a person to wear the cuffs as a garment conveniently and unobtrusively. The cuffs can be used discreetly under clothing as well, providing the needed protection while hiding the cushion from sight. Each cuff is preferably designed to wrap around the arm and be held in place with an adjustable fastener system. The fasteners are preferably hook and loop strips, which not only provide for a snug, yet comfortable fit, but also make the cuffs easy to put on and quick to take off. However, a person can also still easily move about and carry on other activities with the cuffs on. They can even be left on at night, if desired, in preparation for the next feeding or cradling time. Furthermore, the lightweight and compact design of the present invention allows it to be conveniently packed in a pocket, diaper bag, briefcase, suitcase, or other container, taking only minimal space. The present invention allows for the first time, convenient and economical protection from the discomfort associated with cradling a baby, for both the infant and the person cradling the infant, virtually in any place at any time.

These and other features, aspects, and advantages of the present invention will become better understood with regard to the following description, appended claims and accompanying drawings.

DETAILED DESCRIPTION OF THE INVENTION

Figure 6:
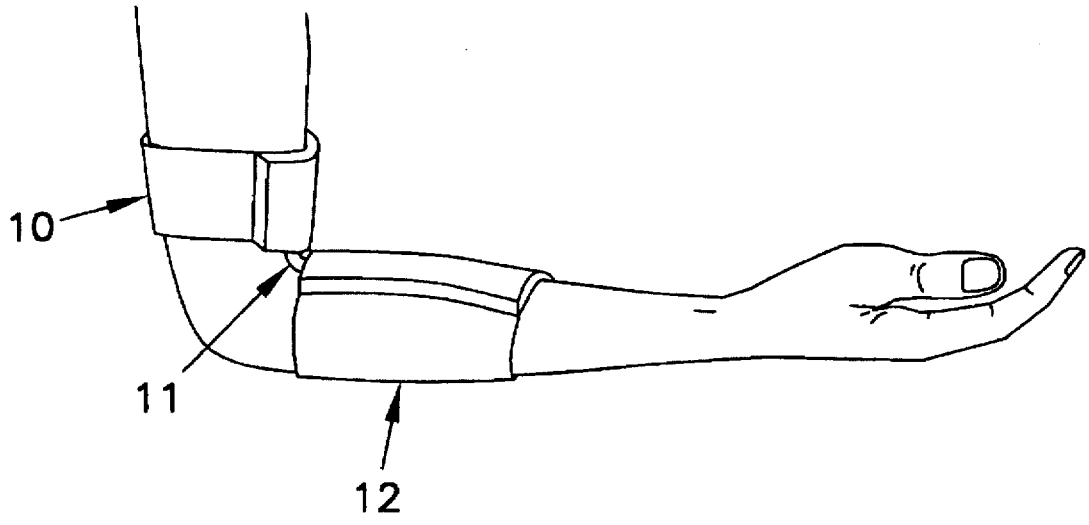
FIG. 6 is a perspective view of one embodiment of the present invention in place upon a person's arm in a closed position ready for use.

One embodiment of the apparatus according to the present invention for cradling a baby with an arm is worn on a person's arm as shown in FIG. 6. A padded biceps cuff 10 is designed to surround the upper arm and a padded forearm cuff 12 is designed to surround the forearm, with a connecting strap 11 between for connecting the padded biceps cuff 10 to the padded forearm cuff 12, providing an economical dual-cuff support cushion for the crook of a person's arm when cradling a baby as shown in FIG. 6.

Figure 1:
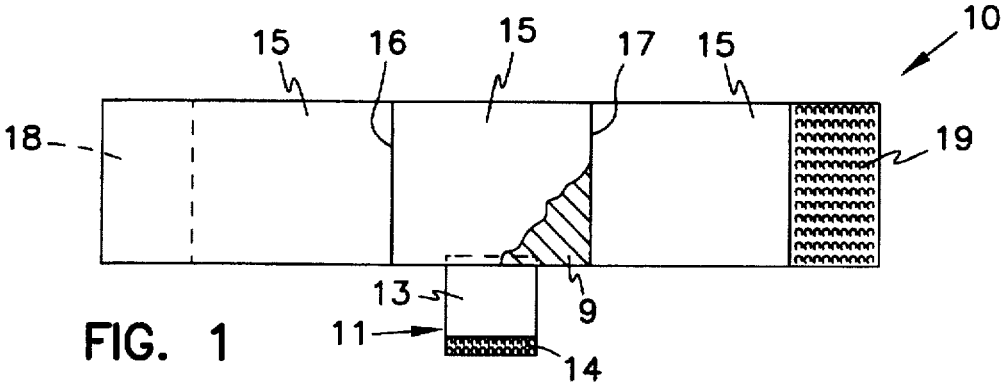
FIG. 1 is a top view, partly broken away, of one embodiment of the padded biceps cuff and the first part of the connecting strap of the present invention.
Figure 3:
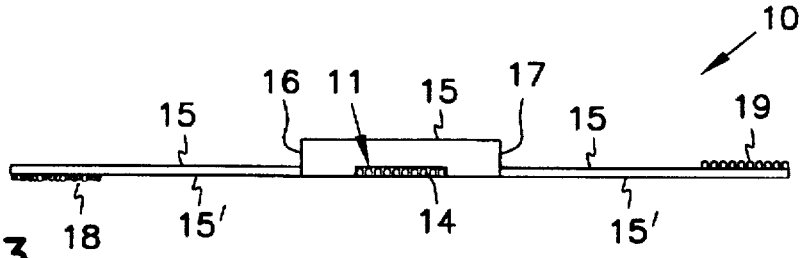
FIG. 3 is a side view of one embodiment of the padded biceps cuff and the first part of the connecting strap of the present invention.

The padded biceps cuff 10 is rectangular and comprises a top biceps cuff outer shell 15, a bottom biceps cuff outer shell 15', a biceps cuff inner filling 9 which is enclosed by the top biceps cuff outer shell 15 and bottom biceps cuff outer shell 15', a two-part biceps fastener system 18 and 19, and a first part of the connecting strap 11 which includes a strap 13 and a connecting strap hook portion 14 as shown in FIGS. 1 and 3. The top biceps outer cuff shell 15 and bottom biceps outer cuff shell 15' are made from any suitable fabric which can be comfortably wrapped around a person's arm. The fabric is preferably a breathable cotton fabric which is also dryer safe. The fabric is most preferably a washable cotton blend stretch terry cloth fabric with cotton bias tape along the seams which conforms to all infant safety requirements (including all non-flamability standards). The top biceps cuff outer shell 15 and the bottom biceps cuff outer shell 15' are joined together, preferably sewn, to form one contiguous biceps cuff outer shell. The biceps cuff outer shell (top 15 and bottom 15') is preferably about 30 to 38 centimeters wide and about four (4) to eight (8) centimeters long as shown in FIGS. 1 and 3. This length and width will accommodate the average-sized biceps, but the biceps cuff outer shell (top 15 and bottom 15') can be made larger or smaller as desired.

The biceps cuff inner filling 9 is made from any suitable filling which provides a cushion or buffer between a person's biceps and a baby's head. The biceps cuff inner filling 9 is preferably a non-toxic soft foam filling which conforms to all infant safety requirements (including all non-flamability standards), is about five (5) to nine (9) centimeters wide and about the same length as the biceps cuff outer shell (top 15 and bottom 15') as shown in FIG. 1. This will provide a suitable area of cushioning in most cases, but a larger or smaller area of cushioning can be used as desired. The biceps cuff inner filling 9 is preferably about 1.5 centimeters thick. This thickness will provide an adequate amount of cushioning in most cases, but a thinner or thicker filling can be used as desired. The biceps cuff inner filling 9 is preferably centered along the length of the biceps cuff outer shell (top 15 and bottom 15'). Therefore, for a biceps cuff outer shell about 36 centimeters wide and a biceps cuff inner filling about eight (8) centimeters wide, the placement of the biceps cuff inner filling is between about fourteen (14) and twenty-two (22) centimeter mark on the biceps cuff outer shell. The biceps cuff inner filling 9 is secured in place, preferably by two seams 16 and 17 which join the top and bottom portions of the biceps cuff outer shell (top 15 and bottom 15') together along the sides of the biceps cuff inner filling 9 as shown in FIGS. 1 and 3.

The two-part biceps cuff fastener system can be any suitable device for securely joining the two end portions of the padded biceps cuff 10 together. The fasteners are preferably comprised of two strips of a hook and loop synthetic material that stick together ("hook and loop"), commonly sold under the trademark Velcro™. The hook and loop preferably conform to all standards for infant safety requirements, have a biceps hook portion 18 located along an end of the bottom biceps cuff outer shell 15' and a biceps loop portion 19 located along an end of the top biceps cuff outer shell 15, with the two portions forming hook and loop strips separated by the width of the padded biceps cuff 10 as shown in FIG. 3. The hook and loop is secured to the biceps cuff outer shell along the length of the padded biceps cuff 10, and is preferably sewn in place. The hook and loop preferably ms the full length of the padded biceps cuff 10 and is sufficiently wide to obtain a secure closure. The width of the hook and loop is most preferably about 1.5 centimeters to about six (6) centimeters. The locations of the biceps hook portion 18 and the biceps loop portion 19 of the fastener system, in regard to which end of the padded biceps cuff 10 each portion is on, is not critical and can be reversed. The locations of the biceps hook portion 18 and biceps loop portion 19 in regard to which portion is on the top biceps cuff outer shell 15 and which is on the bottom biceps cuff outer shell 15' is also not critical and can also be reversed.

Figure 5:
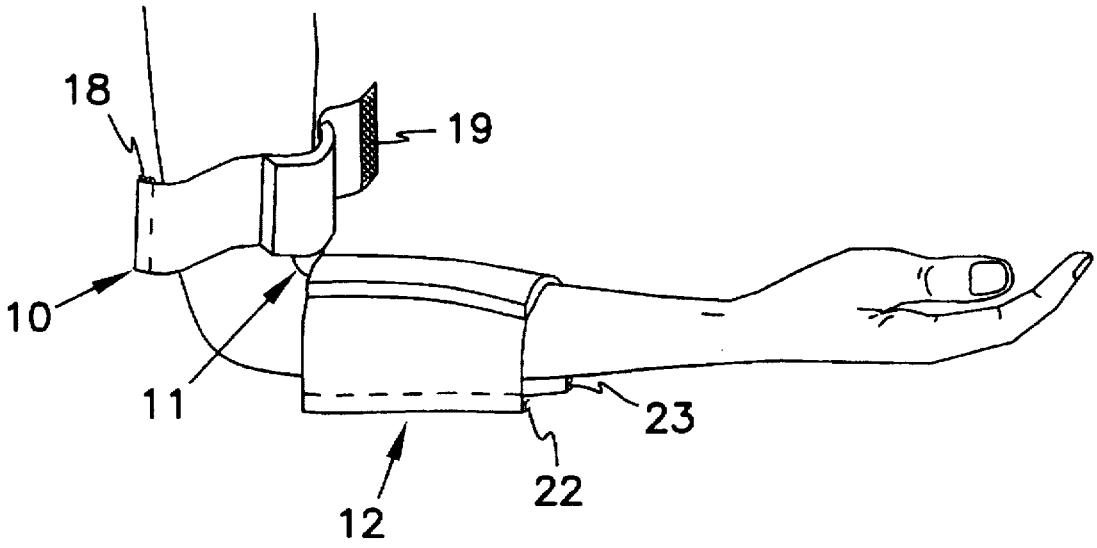
FIG. 5 is a perspective view of one embodiment of the present invention in place upon a person's arm in an open position prior to use.

The padded biceps cuff 10 is worn on the apex portion of the biceps. FIG. 5 shows the padded biceps cuff 10 in position on the arm prior to closure. Closure is obtained by overlapping the two ends of the padded biceps cuff 10 containing the biceps hook portion 18 and the biceps loop portion 19 (i.e., the hook and loop strips) so that the two strips adhere to each other creating a secure and fitted padded biceps cuff 10 as shown in FIG. 6.

Figure 7:
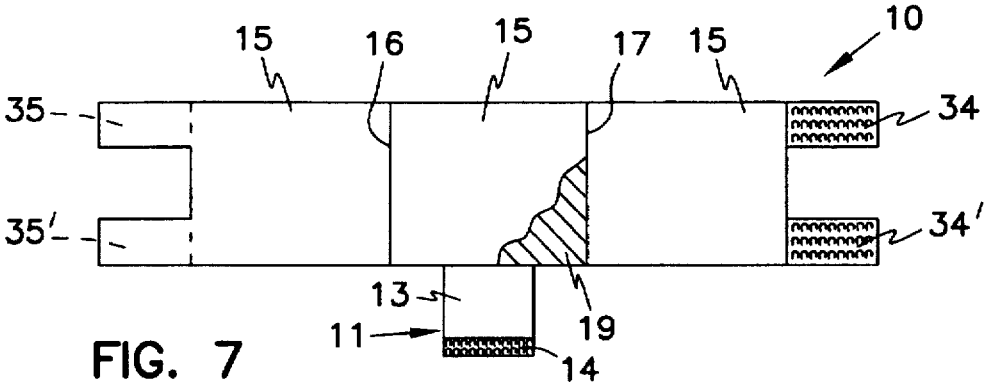
FIG. 7 is a top view, partly broken away, of a second embodiment of the padded biceps cuff and the first part of the connecting strap of the present invention.
Figure 9:
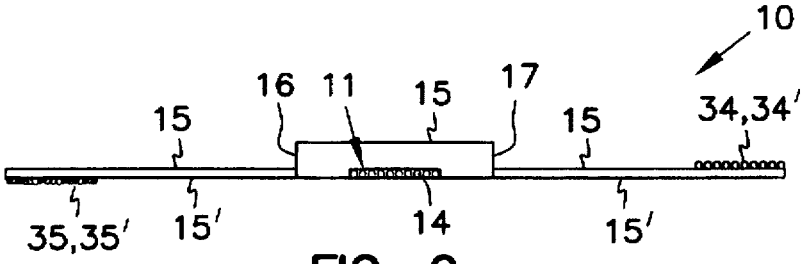
FIG. 9 is a side view of the second embodiment of the padded biceps cuff and the first part of the connecting strap of the present invention.

In a second embodiment of the present invention, as shown in FIG. 7, the two-part biceps cuff fastener system is comprised of at least two biceps hook portions 34 and 34' attached to opposite ends of one short edge of the padded biceps cuff and at least two biceps loop portions 35 and 35' attached to the opposite ends of the other short edge as shown in FIG. 9, so that a secure closure around the upper arm is obtained when each matching hook/loop portion is pressed against the other. The first part of the connecting strap 11 is any suitable device for aiding in connecting the padded biceps cuff 10 and the padded forearm cuff 12 together.

Preferably, the first part of the connecting strap 11 also conforms with all infant safety requirements and comprises a strap 13 and a connecting strap hook portion 14 attached to one end of the strap 13 as shown in FIGS. 1 and 7. The strap 13 is preferably centered along the bottom biceps cuff outer shell 15', and is secured by any suitable securing device, preferably sewn, near the end opposite to the end having the connecting strap hook portion 14 as shown in FIGS. 1 and 3, and also FIGS. 7 and 9. The strap 13 is comprised of a length of fabric sufficient to allow the padded biceps cuff 10 and the padded forearm cuff 12 to be connected. The strap 13 is preferably about three (3) to five (5) centimeters long which will accommodate the average-sized arm, but the strap 13 can be made longer or shorter as desired. The strap 13 is also comprised of a width of fabric sufficient to remain secure to the bottom biceps cuff outer shell 15', preferably about three (3) to five (5) centimeters.

Figure 2:
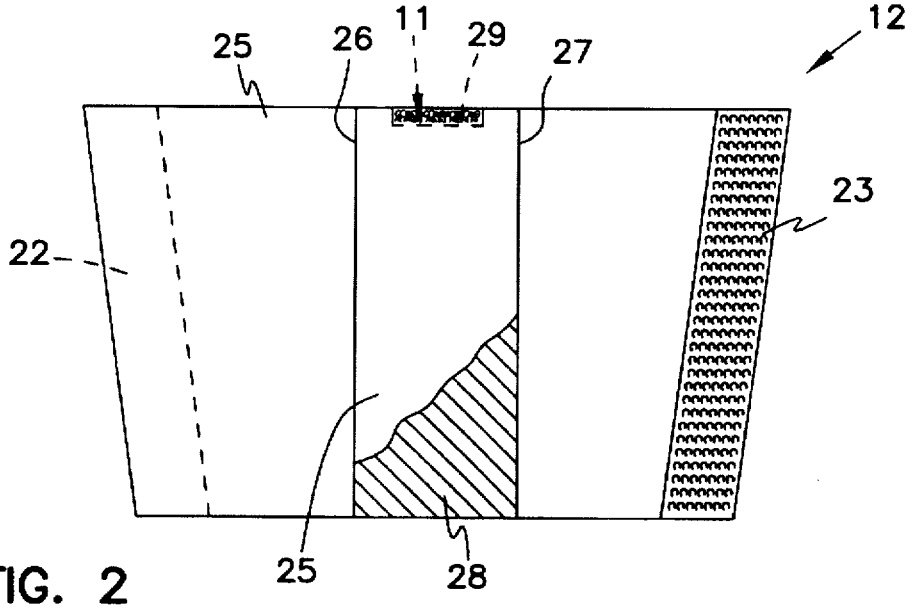
FIG. 2 is a top view, partly broken away, of one embodiment of the padded forearm cuff and the second part of the connecting strap of the present invention.
Figure 8:
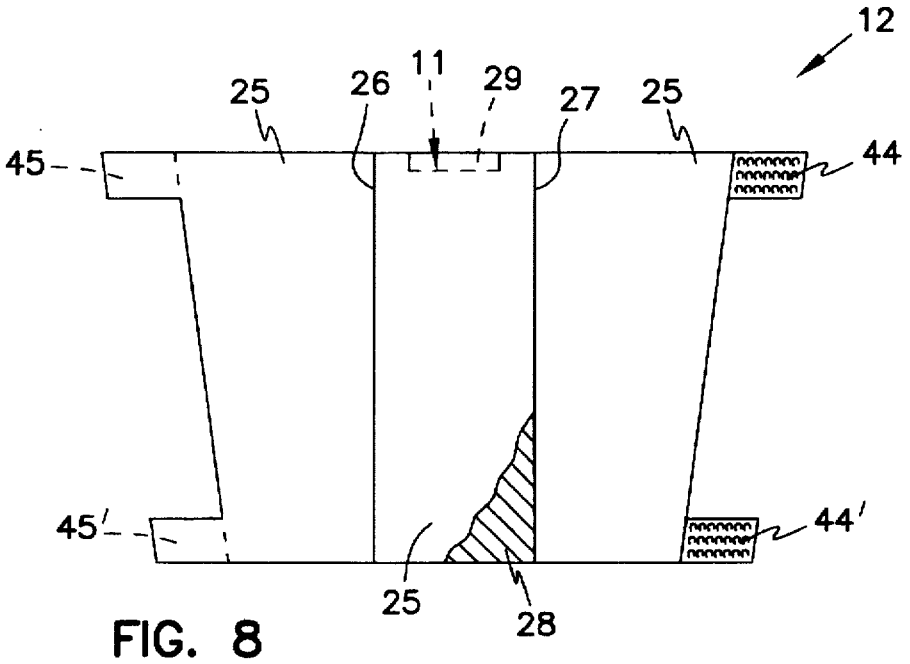
FIG. 8 is a top view, partly broken away, of the second embodiment of the padded forearm cuff and the second part of the connecting strap of the present invention.

The connecting strap hook portion 14 is secured to one end of the strap 13, is preferably sewn in place, and also preferably conforms to all infant safety requirements. The connecting strap hook portion 14 is preferably about the same width as the strap 13, and about one (1) to 2.5 centimeters in length. The connecting strap hook portion 14 is most preferably comprised of a strip of hook which, when pressed against the connecting strap loop portion 29 as shown in FIGS. 2 and 8, will adhere to the connecting strap loop portion 29, forming a secure connection. The connecting strap hook portion 14 does not necessarily need to be pressed against the connecting strap loop portion 29 to form a secure connection, and so can remain detached from the connecting strap loop portion 29 allowing the padded biceps cuff 10 and the padded forearm cuff 12 to remain separate.

Figure 4:
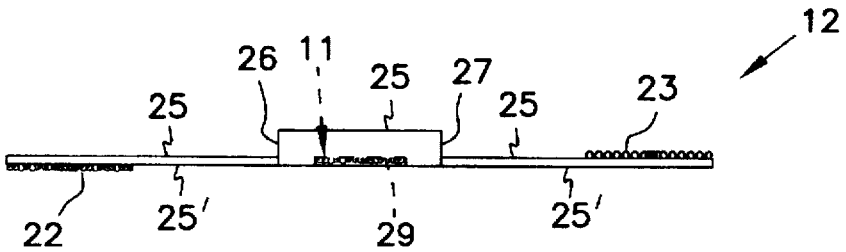
FIG. 4 is a side view of one embodiment of the padded forearm cuff and the second part of the connecting strap of the present invention.

The padded forearm cuff 12 is tapered and comprises a top forearm cuff outer shell 25, a bottom forearm cuff outer shell 25', a forearm cuff inner filling 29 which is enclosed by the top forearm cuff outer shell 25 and bottom forearm cuff outer shell 25', a two-part forearm fastener system 22 and 23, and a second part of the connecting strap 11 comprising a connecting strap loop portion 29 as shown in FIG. 2. The top forearm cuff outer shell 25 and bottom forearm cuff outer shell 25' is made from any suitable fabric which can be comfortably wrapped around a person's arm. The fabric is preferably a breathable cotton fabric which is also dryer safe. The fabric is most preferably a washable cotton blend stretch terry cloth fabric with cotton bias tape along the seams which conforms to all infant safety requirements. The top forearm cuff outer shell 25 and bottom forearm cuff outer shell 25' are joined together, preferably sewn, to form one contiguous forearm cuff outer shell. The forearm cuff outer shell (top 25 and bottom 25') is preferably about 28 to 34 centimeters at the widest end and about 23 to 27 centimeters at the narrowest end and is about ten (10) to sixteen (16) centimeters long as shown in FIGS. 2 and 4. This length and width will accommodate the average-sized forearm, but the forearm cuff outer shell (top 25 and bottom 25') can be made larger or smaller as desired.

The forearm cuff inner filling 28 is made from a suitable filling which provides a cushion or buffer between a person's forearm and a baby's head. The forearm cuff inner filling 28 is preferably a non-toxic soft foam filling which conforms with all infant safety requirements (including all non-flamability standards), is about five (5) to eight (8) centimeters wide and about the same length as the forearm cuff outer shell (top 25 and bottom 25') as shown in FIG. 2. This will provide a suitable area of cushioning in most cases, but a larger or smaller area of cushioning can be used as desired. The forearm cuff inner filling 28 is preferably about 1.5 centimeters thick. This thickness will provide an adequate amount of cushioning in most cases, but a thinner or thicker filling can be used as desired. The forearm cuff inner filling 28 is preferably centered along the length of the forearm cuff outer shell (top 25 and bottom 25'). The forearm cuff inner filling 28 is secured in place, preferably by two seams 26 and 27 which join the top and bottom portions of the forearm cuff outer shell (top 25 and bottom 25') together along the sides of the forearm cuff inner filling 28 as shown in FIGS. 2 and 4.

The two-part forearm cuff fastener system 22 and 23 can be any suitable device for securely joining the two end portions of the padded forearm cuff 12 together. The fasteners are preferably hook and loop strips comprising a forearm hook portion 22 located along an end of the bottom forearm cuff outer shell 25' and a forearm loop portion 23 located along an end of the top forearm cuff outer shell 25 with the two portions separated by the width of the padded forearm cuff 12. The hook and loop is secured by any suitable device, preferably sewn to the forearm cuff outer shell along the length of the padded forearm cuff 12. The hook and loop most preferably runs the full length of the padded forearm cuff 12 and is sufficiently wide to obtain a secure closure. The width of the hook and loop is most preferably about 1.5 to six (6) centimeters. The locations of the forearm hook portion 22 and the forearm loop portion 23 of the fastener system in regard to which end of the padded forearm cuff 12 each portion is on, is not critical and can be reversed. The locations of the forearm hook portion 22 and forearm loop portion 23 in regard to which portion is on the top forearm cuff outer shell 25 and which is on the bottom forearm cuff outer shell 25' is also not critical and can also be reversed.

The padded forearm cuff 12 is worn on the inner, top portion of the forearm. FIG. 5 shows the padded forearm cuff 12 of in position on the arm prior to closure. Closure is obtained by overlapping the two ends of the padded forearm cuff 12 containing the forearm hook portion 22 and the forearm loop portion 23 (i.e., the hook and loop strips) so that the two strips adhere to each other creating a secure and fitted padded forearm cuff 12 as shown in FIG. 6.

Figure 10:
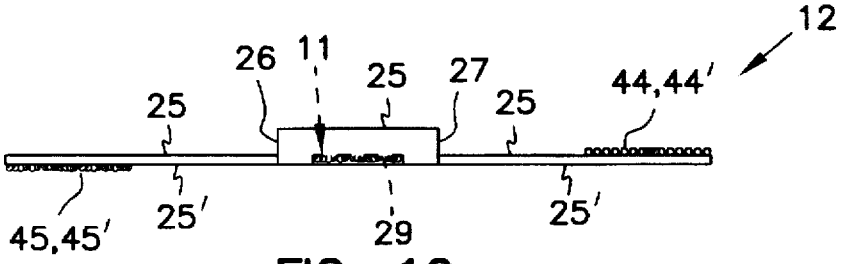
FIG. 10 is a side view of the second embodiment of the padded biceps cuff and the second part of the connecting strap of the present invention.

In the second embodiment, as shown in FIG. 8, the two-part forearm cuff fastener system is comprised of at least two forearm hook portions 44 and 44' attached to opposite ends of one short edge of the padded forearm cuff and at least two forearm loop portions 45 and 45' attached to the opposite ends of the other short edge as shown in FIG. 10, so that a secure closure around the forearm is obtained when each matching hook/loop portion is pressed against the other.

The second part of the connecting strap 11 is any suitable device for aiding in connecting the padded biceps cuff 10 and the padded forearm cuff 12 together. Preferably, the second part of the connecting strap 11 is a connecting strap loop portion 29 which is centered on the bottom forearm cuff outer shell 25' and secured by any suitable securing device, preferably sewn, as shown in FIGS. 2 and 4. The connecting strap loop portion 29 is preferably comprised of a strip of loop which, when pressed against the connecting strap hook portion 14 as shown in FIG. 1, will adhere to the connecting strap loop portion 29, forming a secure connection. The connecting strap loop portion 29 is preferably about the same width as the connecting strap hook portion 14 and is sufficiently long to create a secure connection with the connecting strap hook portion 14, most preferably about one (1) to 2.5 centimeters in length. The connecting strap loop portion 29 does not necessarily need to be pressed against the connecting strap hook portion 14 to form a secure connection, and so can remain detached from the connecting strap hook portion 14 allowing the padded biceps cuff 10 and the padded forearm cuff 12 to remain separate.

The strap 13 of the connecting strap 11 rests on the arm between the padded biceps cuff 10 and the padded forearm cuff 12 as shown in FIG. 5. By securing the connecting strap hook portion 14 with the connecting strap loop portion 29 (i.e., the hook and loop strips), the cuffs will remain in position during use providing a secure dual-cuff apparatus which will fully cushion the crook of a person's arm when cradling a baby.

If desired, however, the connecting strap 11 can remain in the open position during use so that the padded biceps cuff is detached from the padded forearm cuff 12. In this way, the padded forearm cuff can be worn and used independently of the padded biceps cuff and vice versa.

Alternatively, the apparatus of the present invention can contain no connecting strap 11, such that the padded biceps cuff 10 and the padded forearm cuff 12 are not connectable and worn and used independently.

Figure 11:
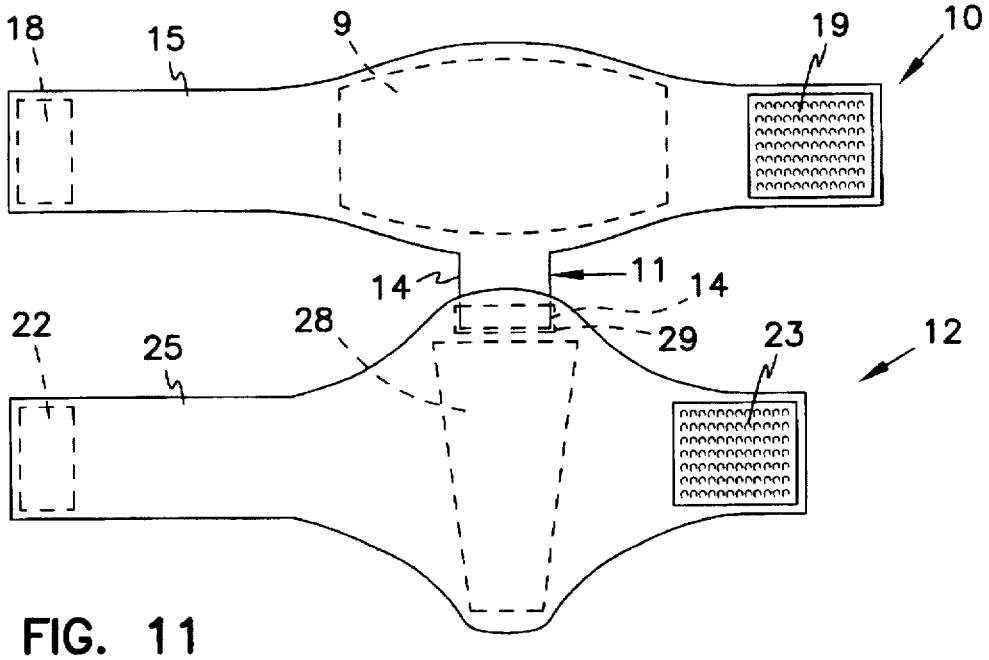
FIG. 11 is a top view of a third embodiment of the padded biceps cuff connected to the padded forearm cuff.
Figure 12:
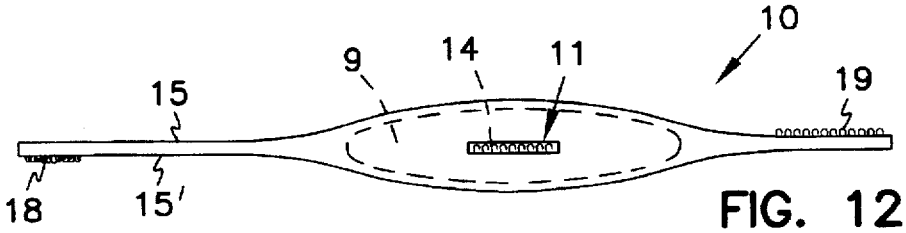
FIG. 12 is a side view of the third embodiment of the padded biceps cuff.

In a third embodiment, as shown in FIGS. 11 and 12, the padded biceps cuff 10 can alternatively be primarily rectangular, but convex in the area of the biceps cuff inner filling 9. The biceps cuff inner filling 9 can be any suitable shape in this embodiment, but is preferably convex along its two outer edges in the same manner as the padded biceps cuff 10 and also has two straight inner edges. The padded biceps cuff 10 wraps around the biceps and is secured by the two-part biceps cuff fastener system 18 and 19. The connecting strap 11 is contiguous with the padded biceps cuff 10 and extends outwardly from the center as shown in FIG. 11.

Figure 13:
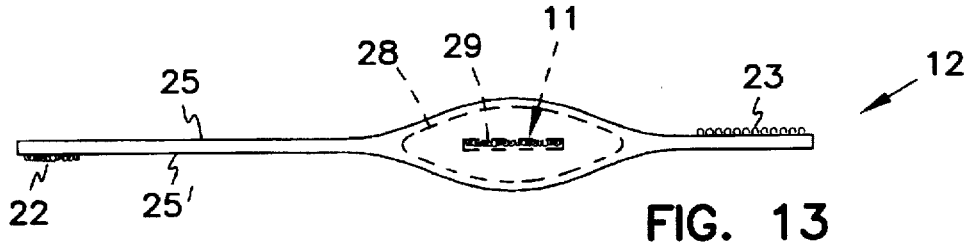
FIG. 13 is a side view of the third embodiment of the padded forearm cuff.
Figure 14:
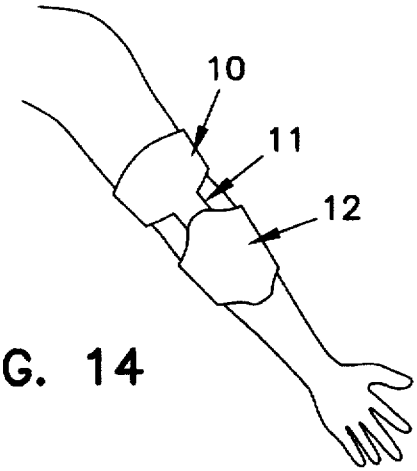
FIG. 14 is a perspective view of the third embodiment of the present invention in place upon a person's arm in a closed position ready for use.

Also, as shown in the third embodiment in FIGS. 11 and 13, the padded forearm cuff 12 can alternatively be convex in the area of the forearm cuff inner filling 28. The forearm cuff inner filling 28 can be any suitable shape in this embodiment, but is preferably tapered with the widest end being next to the connecting strap loop portion 29. The portion of the padded forearm cuff 12 which wraps around the forearm is rectangular-shaped and the padded forearm cuff 12 is secured by the two-part forearm cuff fastener system 22 and 23. FIG. 14 shows the third embodiment in a closed position on a person's arm ready for use.

The two-part fastener system, preferably comprised of hook and loop strips on the padded biceps cuff and the padded forearm cuff of the present invention, allows for the apparatus to be snugly fit to most any adult-sized arm. The detachable connecting strap allows a person to wear each cuff independent of the other to provide protection in either the biceps or the forearm area, or to wear and use both cuffs without connecting them, if desired.

There can also be many situations including special events or public appearances or simply personal choice where it is desirable to conceal the cushioning device. The cuff design of the present apparatus can conveniently and discreetly be worn as a garment under many types of long sleeves so that the needed protection is obtained while the appropriate appearance of the person holding the baby is maintained.

The adjustable two-part fastener system, preferably hook and loop strips, not only provides adjustability for a snug, yet comfortable fit, but also makes the apparatus easy to put on and quick to take off. However, a person can also still easily move about and carry on other activities with the apparatus in place when not cradling the baby during the day and the apparatus can even be left on at night, if desired, in preparation for the next feeding or cradling time.

There are also situations when a person needing the cushioning protection of the present invention must travel away from home for a trip or simply an outing. The lightweight and compact design of the present invention allows the apparatus to be conveniently packed in a pocket, diaper bag, briefcase, suitcase or other container, taking only minimal space. For the first time, an infant can be provided with extra comfort while being cradled, and a person can be protected from soreness and stiffness and blood flow restriction to an arm from cradling a baby virtually in any place at any time. The present invention provides an economical, dual-cuff infant support cushion which is non-toxic, machine-washable, dryer-safe, breathable, and conforms with all infant-safety requirements (including all standards for non-flamability). It can be made from any color fabric, such as infant pastel colors or bold print patterns.

Although the present invention has been described in considerable detail with reference to three preferred versions thereof, other versions are possible. Therefore, the spirit and scope of the appended claims should not be limited to the description of the preferred embodiments contained herein.

What is claimed is:

1. An apparatus for cradling with an arm, a baby, said apparatus comprising:

(a) a padded biceps cuff for surrounding an upper arm and said padded biceps cuff conforming to all infant safety requirements;

(b) a padded forearm cuff for surrounding a forearm and said padded forearm cuff conforming to all infant safety requirements; and (c) a strap comprising fabric of a length sufficient to connect the padded biceps cuff to the padded forearm cuff to create a dual-cuff infant support cushion;

both said padded biceps cuff and said padded forearm cuff are comprised of an outer shell and an inner filling; wherein said biceps cuff outer shell surrounds the inner filling of said padded biceps cuff and said forearm cuff outer shell surrounds the inner filling of the padded forearm cuff;

said outer shell of the padded forearm cuff is tapered and is comprised of a top forearm cuff outer shell and a bottom forearm cuff outer shell which are joined together along a seam to form one contiguous forearm cuff outer shell; wherein the widest end of the forearm cuff outer shell is worn near the elbow portion of the forearm;

said outer shell of the padded biceps cuff and said outer shell of the padded forearm cuff are each comprised of a dryer safe breathable fabric; and said inner filling of the padded biceps cuff and said inner filling of the padded forearm cuff are each of a non-toxic soft foam filling, wherein the inner filling of each cuff is positioned approximately in the center of the respective outer shell.

2. The apparatus as recited in claim 1 wherein the outer shell of the padded biceps cuff is rectangular and is comprised of a top biceps cuff outer shell and a bottom biceps cuff outer shell which are joined together along a seam to form one contiguous biceps cuff outer shell.

3. The apparatus as recited in claim 2 wherein the biceps cuff outer shell is about thirty (30) to thirty-eight (38) centimeters wide and about four (4) to eight (8) centimeters long.

4. The apparatus as recited in claim 1 wherein the widest end of the forearm cuff outer shell is about twenty-eight (28) to thirty-four (34) centimeters and the narrowest end is about twenty-three (23) to twenty-seven (27) centimeters, further wherein the length of the padded forearm cuff is about ten (10) to sixteen (16) centimeters.

5. The apparatus as recited in claim 1 wherein the outer shell of the padded biceps cuff and the outer shell of the forearm cuff are each comprised of a washable cotton blend stretch terry cloth fabric with cotton bias tape along the seams.

6. The apparatus as recited in claim 1 wherein the inner filling of the padded biceps cuff is secured in place by a suitable securing means, and is about five (5) to nine (9) centimeters wide and about the same length as the outer shell of the padded biceps cuff, further wherein the inner filling of the padded biceps cuff is worn on the apex area of a biceps.

7. The apparatus as recited in claim 1 wherein the inner filling of the padded forearm cuff is secured in place by suitable securing means, is about five (5) to eight (8) centimeters wide and about the same length as the outer shell of the padded forearm cuff, further wherein the inner filling of the padded forearm cuff is worn on the inner, top portion of the forearm.

8. The apparatus as recited in claim 1 wherein the padded biceps cuff is closed by wrapping the padded biceps cuff around the arm so that a first end having at least one biceps hook portion and a second end having at least one biceps loop portion form a secure closure around the upper arm when the two ends are pressed together.

9. The apparatus as recited in claim 8 further wherein the biceps hook portion and the biceps loop portion are each about 1.5 to six (6) centimeters wide.

10. The apparatus as recited in claim 1 wherein the padded forearm cuff is closed by wrapping the padded forearm cuff around the arm so that a first end having at least one forearm hook portion and a second end having at least one forearm loop portion form a secure closure around the forearm when the two ends are pressed together.

11. The apparatus as recited in claim 10 further wherein the forearm hook portion and the forearm loop portion are each about 1.5 to six (6) centimeters wide.

12. The apparatus as recited in claim 1 wherein the strap means includes:

(a) a first part having a strap, wherein one end of the strap is centered on the padded biceps cuff and the other end of the strap is attached to a connector hook portion;

(b) a second part having a connector loop portion centered on the padded forearm cuff wherein the connector hook portion and the connector loop portion form a secure closure when pressed together to connect and keep in place the padded biceps cuff and the padded forearm cuff.

13. The apparatus as recited in claim 12 wherein the strap is about three (3) to five (5) centimeters wide and three (3) to five (5) centimeters long, and the connector hook portion and connector loop portion are each about three (3) to five (5) centimeters wide and about one (1) to 2.5 centimeters long.

14. The apparatus as recited in claim 12 wherein the first part of the strap is contiguous with the padded biceps cuff and extends outwardly therefrom.

15. The apparatus as recited in claim 12 wherein the connector hook portion and the connector loop portion of the strap means are kept apart whereby the padded forearm cuff and the padded biceps cuff can be worn independently of one another.

16. The apparatus as recited in claim 1 wherein the padded biceps cuff is primarily rectangular with a convex shape in the area adjacent to the biceps cuff inner filling.

17. The apparatus as recited in claim 1 wherein the padded forearm cuff is a convex shape in the area adjacent to the forearm cuff inner filling.

18. The apparatus as recited in claim 1 wherein the strap is detachable.

19. A method for providing protection to a person's arm and a baby's head, while cradling a baby, comprising the steps of:

(a) wrapping a padded biceps cuff around an upper arm;

(b) wrapping a padded forearm cuff around a forearm on the same arm on which the padded biceps cuff has been placed;

(c) using a strap comprising fabric of a sufficient length for connecting the padded biceps cuff to the padded forearm cuff to create a dual-cuff infant support cushion which maintains its position during use and provides protection from the discomfort associated with cradling; and laying said baby's head on said padded biceps cuff and said padded forearm cuff, thus providing a cushioned resting place for said baby's head.

20. The method as recited in claim 19 further wherein the padded biceps cuff and the padded forearm cuff are worn independently of each other.

21. The method as recited in claim 19 wherein the strap in step (c) is detachable.

* * * * *